US009271580B2

(12) United States Patent
Beekman

(10) Patent No.: US 9,271,580 B2
(45) Date of Patent: Mar. 1, 2016

(54) BABY CARRIER COVER ASSEMBLY

(71) Applicant: Sindy Beekman, Los Angeles, CA (US)

(72) Inventor: Sindy Beekman, Los Angeles, CA (US)

( * ) Notice: Subject to any disclaimer, the term of this patent is extended or adjusted under 35 U.S.C. 154(b) by 39 days.

(21) Appl. No.: 14/305,415

(22) Filed: Jun. 16, 2014

(65) Prior Publication Data

US 2015/0359356 A1 Dec. 17, 2015

(51) Int. Cl.
*A47D 13/02* (2006.01)
*A47D 15/00* (2006.01)

(52) U.S. Cl.
CPC ..... *A47D 13/02* (2013.01); *A47D 15/00* (2013.01)

(58) Field of Classification Search
CPC ..... A47D 13/02; A47D 15/00
See application file for complete search history.

(56) References Cited

U.S. PATENT DOCUMENTS 5,848,741 A * 12/1998 Fair ..... A47C 7/66 224/160
8,701,949 B1 * 4/2014 Lehan ..... A45F 3/047 224/160
2005/0017042 A1 * 1/2005 Friou ..... A45F 5/02 224/660
2005/0045674 A1 * 3/2005 Rehbein ..... A47D 13/025 224/160
2005/0051582 A1 * 3/2005 Frost ..... A47D 13/025 224/160
2006/0213943 A1 * 9/2006 Gold ..... A45F 3/04 224/576
2007/0175939 A1 * 8/2007 Gold ..... A45F 3/04 224/576
2009/0206116 A1 * 8/2009 Grant ..... A45F 3/08 224/160
2011/0062195 A1 * 3/2011 Jones ..... A47D 13/025 224/161
2012/0061429 A1 * 3/2012 Sauer ..... A47D 13/025 224/160
2012/0241487 A1 * 9/2012 Zack ..... A47D 13/025 224/576
2012/0318833 A1 * 12/2012 Zack ..... A47D 13/025 224/160
2014/0131401 A1 * 5/2014 Workman ..... A47D 13/025 224/160

* cited by examiner

*Primary Examiner* — Brian D Nash
(74) *Attorney, Agent, or Firm* — Lewis Brisbois Bisgaard & Smith LLP; Josephine Ann Brosas

(57) ABSTRACT

A cover assembly for a body-mounted soft structured baby carrier which provides protection from the elements (such as the sun or other elements) via a hood for the baby being carried which has an outer shell configured in the shape of an animal, fantastical creature, video game character, superhero or princess, and is capable of being removably attached or secured to an existing chest-mounted soft structured baby carrier using upper and lower straps which attach to the upper and lower securing straps on the existing body-mounted soft structured baby carrier.

13 Claims, 10 Drawing Sheets

BABY CARRIER COVER ASSEMBLY

FIELD OF INVENTION

The presently described invention relates generally to covers for body-mounted, hands-free soft structured baby carriers. In particular, the invention resides in a series of covers which attach to, and are removable from, soft structured baby carriers.

BACKGROUND

Baby carriers are convenient for parents, especially for new parents who are trying to adjust to their new life and schedule with a baby. Babies love carriers because it allows them to snuggle up close to the wearer, while parents are still able to get chores done around the house and run errands wherever they need to go. Arms quickly grow sore from carrying around a baby, and carriers help give tired muscles a break.

There are various types of baby carriers including ring-slings, wraps, pouches, soft structured carriers, and structured carriers. There are baby carriers for the back and for the chest.

Baby carriers originated with a chest-mounted version that is both classic and extremely popular today. In these carriers, the baby can face either inward or outward toward an adoring public just waiting to say hello. This style is especially popular with new dads, as it is simple and convenient. They can usually hold babies up to 25 pounds, and are manufactured by a variety of brands such as Ergobaby®, Bjorn®, Infantino®, and Beco®.

Use of a chest-mounted soft structured baby carrier is an ideal way to carry an infant as wearing a baby frees the hands of the wearer for important tasks like checking email or sipping drinks, and eliminates the need for a bulky stroller. It has also been shown to be a boon for the development of the bonding between the baby and the wearer as it allows the baby to be spend time being close to the wearer.

However, none of the chest-mounted soft structured baby carriers on the market today include a removable cover that provides protection for the baby from the elements, such as the sun and other elements. Of the chest-mounted soft structured baby carriers presently on the market that have hoods, the hoods are primarily used to hold the baby's head up when they are sleeping, but are really light and do not provide adequate protection of the baby's fragile skin from the sun or other elements. The present invention, a body-mounted soft structured baby carrier cover, provides a stylish and fun way to provide protection from the elements to the baby being carried, while being able to attach to and removed from many of the body-mounted soft structured baby carriers presently on the market. Further, the present invention does not inhibit functionality of the baby carrier itself, including access to the hoodie or pocket.

SUMMARY OF THE INVENTION

The presently described invention relates generally to a cover which can be removably attached to soft structured baby carriers presently on the market. It also provides protection (such as from the sun or other elements) for a baby in a body-mounted soft structured baby carrier. The cover is referred to as a baby carrier cover.

The present invention can come in a variety of materials which are machine-washable, including, but not limited to: cotton, polyester, broadcloth, fleece, twill, denim, poly-lin, poly-crepe and poly-satins.

The present invention also comes in a variety of predetermined shapes including, but not limited to: animals (dog, cat, tiger, lion, panda, cow, bear, shark, turtle, koala, kangaroo, dinosaur, etc.), fantastical creatures (dragons, unicorns, hobbits, etc.), video game characters, superheroes and princesses.

The baby carrier cover of the present invention is able to fit onto an existing body-mounted soft structured baby carrier by the use of straps, such as elastic straps, for attachment at operative locations. The baby carrier cover has an outer shell, an inner shell, an extension such as a hood for protection of the baby's head from, the sun and other elements, and elastic attachment straps.

There are several configurations of the straps for attachment of the carrier cover to the carrier. These configurations include the use of elastic straps. Another configuration includes the use of buttons or snaps to secure the straps of the carrier cover to the carrier, and the use of hook and loop attachment (commonly known as "Velcro®") to secure the straps of the carrier cover to the carrier.

The baby carrier cover of the present invention is removable and can be used with a variety of existing baby carrier brands such as Ergobaby®, Bjorn®, Infantino®, and Beco®.

The present invention also provides protection from the elements to the baby being carried such as through use of a hood while being able to attach to and removed from any of the body-mounted soft structured baby carriers presently on the market.

BRIEF DESCRIPTION OF THE DRAWINGS

The foregoing aspects and the attendant advantages of the present invention will become more readily appreciated by reference to the following detailed description, when taken in conjunction with the accompanying drawings, wherein.

DETAILED DESCRIPTION

Figure 1:
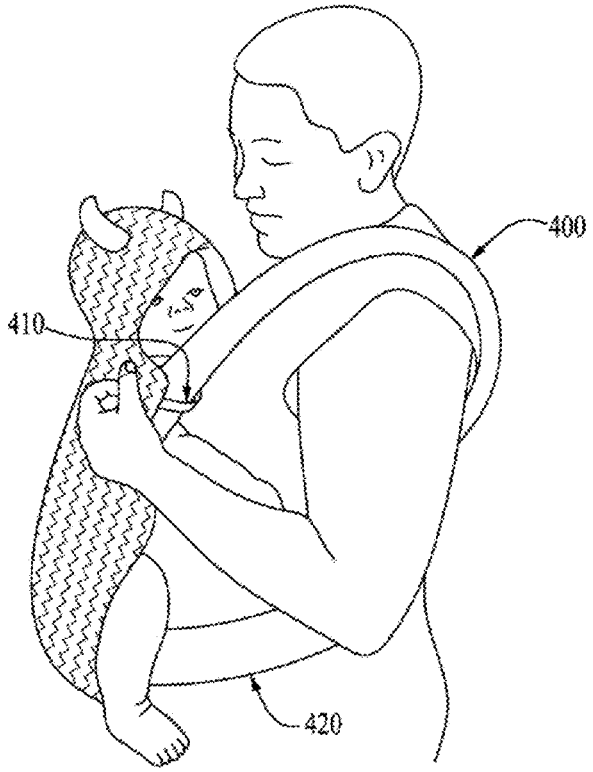
FIG. 1 is a side perspective view of an embodiment of a baby carrier cover of the present invention when attached to the chest-mounted soft structured baby carrier being worn on the body of a person.

The presently described invention relates generally to a baby carrier cover that is removable and provides protection from the elements (such as the sun and other elements) to a baby being carried in a body-mounted soft structured baby carrier (490). The cover is referred to as the baby carrier cover (100).

Various aspects of specific embodiments of the baby carrier cover are disclosed in the following description and related drawings. Alternate embodiments may be devised without departing from the sprit or the scope of the present disclosure. Additionally, well-known elements of exemplary embodiments will not be described in detail or will be omitted so as not to obscure relevant details. The term "embodiments" is not exhaustive and does not require that all embodiments include the discussed feature, advantage or mode of operation.

The baby carrier cover (100) can come in a variety of materials which are preferably machine-washable, including, but not limited to: cotton, polyester, broadcloth, fleece, twill, denim, poly-lin, poly-crepe and poly-satins.

The baby carrier cover (100) has an outer shell (200) which can come in a variety of shapes and configurations including, but not limited to: animals (dog, cat, panda, cow, lion, tiger, bear, shark, turtle, koala, kangaroo, dinosaur, etc.), fantastical creatures (dragons, unicorns, hobbits, etc), video game characters, superheroes and princesses.

The baby carrier cover (100) is removable and is able to fit onto an existing body-mounted soft structured baby carrier (400) by the use of elastic straps for attachment (310 and 320) at operative locations (410 and 420). A preferred embodiment of the baby carrier cover has an outer shell, an inner shell, an extension such as a hood for protection of the baby's head from the sun and other elements, and a pair of upper attachment straps and a pair of lower attachment straps.

The hood (210) is an integral part, of the baby carrier cover (100) as most of the chest-mounted soft structured baby carriers (400) presently on the market do not include hoods, or if they do, the hoods on existing soft structured baby carriers (400) are primarily used to hold the baby's head up when they are sleeping, but are made of light fabrics and do not provide adequate protection of the baby's fragile skin from the sun or other elements. The hood (210) on the baby carrier cover (100) is preferably made of thick and durable fabric which are of an operative thickness to provide protection to the baby's head from the sun and other elements. Further, the baby carrier cover (100) does not inhibit functionality of the soft structured baby carrier (400) itself, including access to the hoodie or pocket of the soft structured baby carrier (400).

FIG. 1 is a side perspective view of the baby carrier cover (100) when attached to the chest-mounted soft structured baby carrier (400) being worn by a person carrying a baby.

Figure 2:
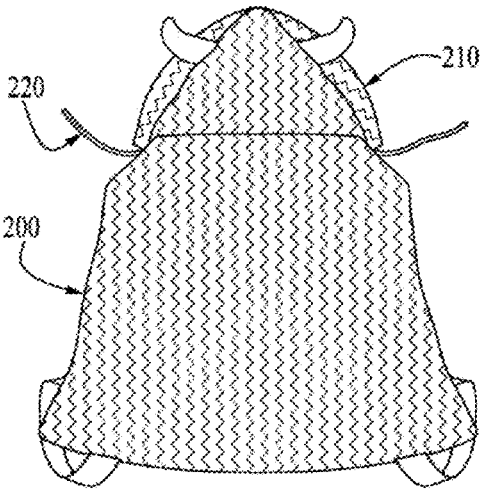
FIG. 2 is a top plan view of the outer shell of the FIG. 1 embodiment which is worn facing away from the wearer's body.

FIG. 2 is a top plan view of the outer shell (200) of the baby carrier cover (100) which is worn facing away from the wearer's body.

The outer shell (200) extends above the body-mounted soft structured baby carrier (400) to provide protection for the baby being carried. This protection may be in a configuration such as via a hood (210) for protection of the baby's head from the sun and other elements. The hood can be tightened to fit securely around the baby being carried by use of a string or a plurality of strings (220).

Figure 3:
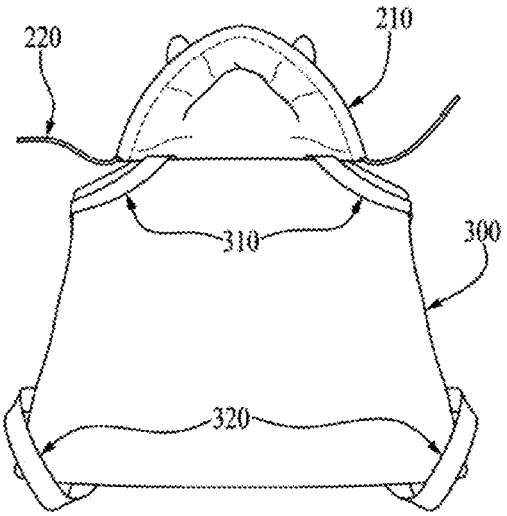
FIG. 3 is a bottom plan view of the inner shell of the FIG. 1 embodiment which is worn toward the wearer's body.

FIG. 3 is a bottom plan view of the inner shell (300) of the baby carrier cover (100) which is worn toward the wearer's body. The inner shell (300) has an upper portion and a lower portion.

Attached to the inner shell (300) are upper elastic attachment straps (310) and lower elastic attachment straps (320). In the embodiment shown in FIG. 3, the upper elastic attachment straps (310) and lower elastic attachment straps (320) are each comprised of a single piece of fabric (preferably elastic), which is anchored (such as by stitching) to the inner shell (300). Each of the upper elastic attachment straps (310) is anchored to the upper portion of the inner shell, and each of the lower elastic attachment straps (320) is anchored to the lower portion of the inner shell. The upper elastic attachment straps and lower elastic attachment straps may also be anchored to the outer shell (200), or in between the outer shell (200) and inner shell (300).

Figure 4:
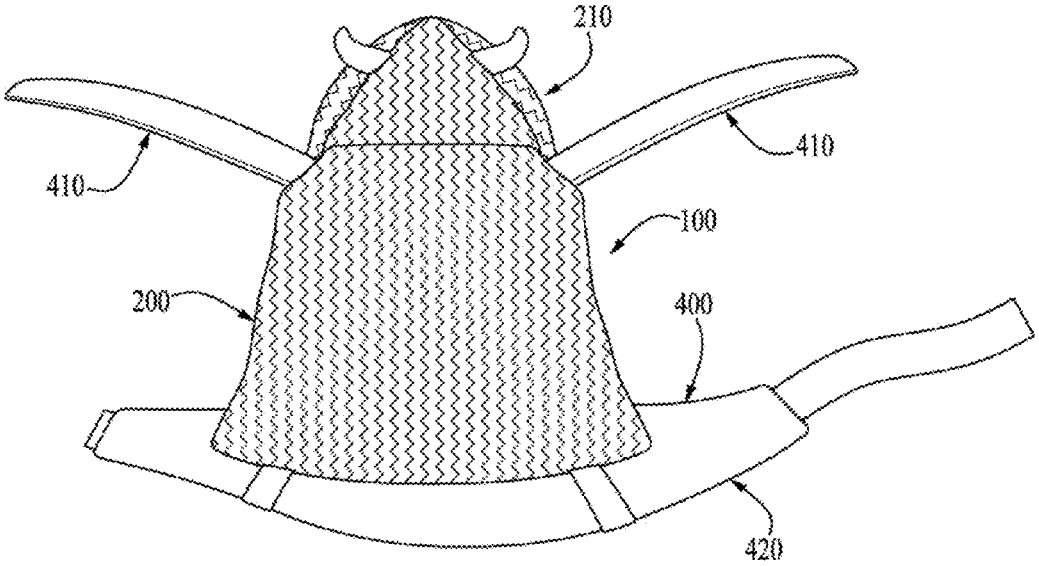
FIG. 4 is a top plan view of the outer shell of the FIG. 1 embodiment attached to the body-mounted soft structured baby carrier.

FIG. 4 is a top plan view of the outer shell (200) of the baby carrier cover (100) attached or secured to the body-mounted soft structured baby carrier (400).

Figure 5:
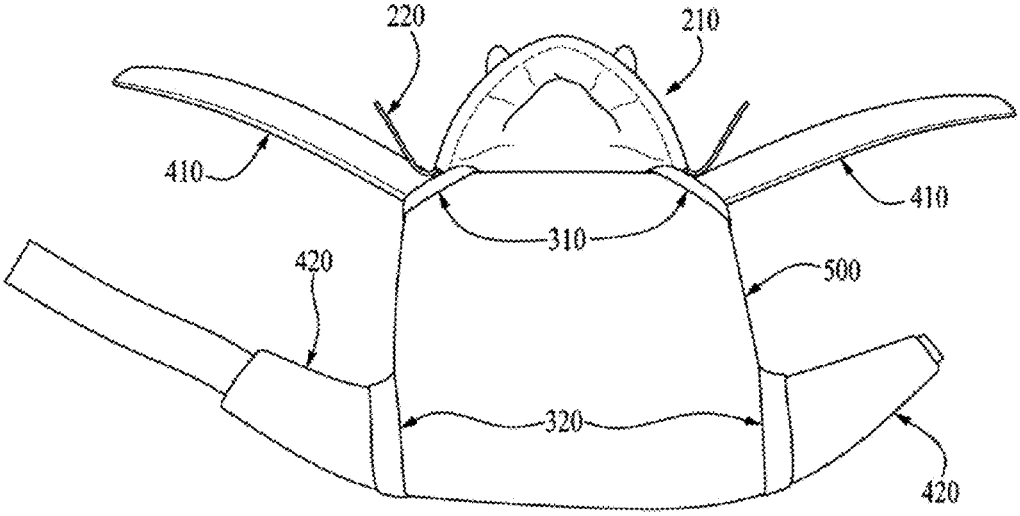
FIG. 5 is a bottom plan view of the FIG. 1 embodiment showing the attachment straps when attached or secured to the body-mounted soft structured baby carrier.

FIG. 5 is a bottom plan view of the elastic attachment straps (310 and 320) of the baby carrier cover (100) when attached or secured to the body-mounted soft structured baby carrier showing the inner shell of the body-mounted soft structured baby carrier (400).

The lower elastic attachment straps (320) slide over the body-mounted soft structured baby carrier's (400) lower securing straps (420). The upper elastic attachment straps (310) slide over the body-mounted soft-structured baby carrier's (400) upper securing straps (410).

Figure 6:
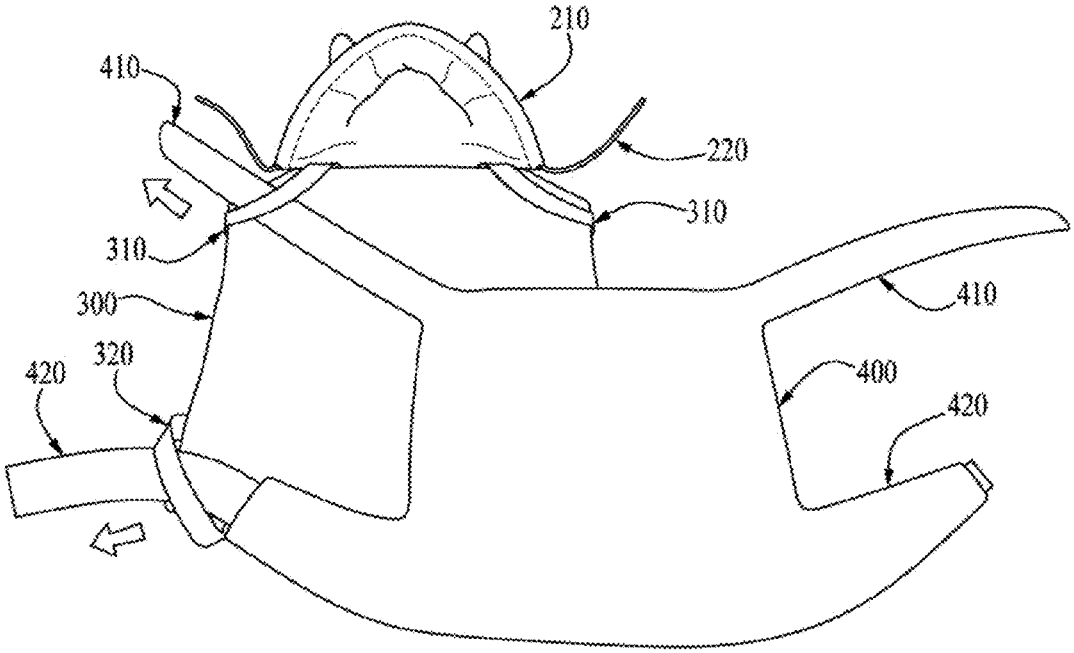
FIG. 6 is a bottom plan view of the FIG. 1 embodiment baby carrier cover, and a body-mounted soft structured baby carrier, showing how the attachment straps of the baby carrier cover are attached to the body-mounted soft structured baby carrier.

FIG. 6 shows how the baby carrier cover (100) is secured to the body-mounted soft-structured baby carrier. This shows an embodiment of the baby carrier cover assembly. As shown in FIG. 6, the upper elastic attachment strap (310) of the baby carrier cover slides over the upper securing strap (410) on each side of the body-mounted soft structured baby carrier (400), and the lower elastic attachment strap (320) of the baby carrier cover slides over the lower securing strap (420) on each side of the body-mounted soft structured baby carrier (400).

Figure 7:
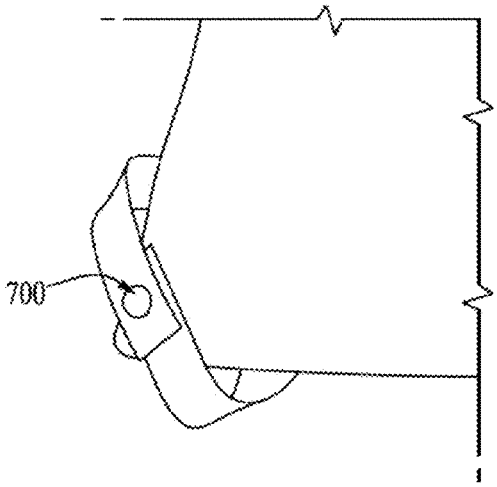
FIG. 7 is a configuration of the attachment straps of another embodiment of the present invention whereby buttons or snaps are used to secure the straps to the body-mounted soft structured baby carrier.

FIG. 7 shows an alternate embodiment of the upper and lower attachment straps (310 and 320) of the baby carrier cover (100) using buttons or snaps (700) to secure the straps to the baby carrier, in lieu of a single elastic piece for each the upper attachment strap (310) and lower attachment strap (320).

Figure 8:
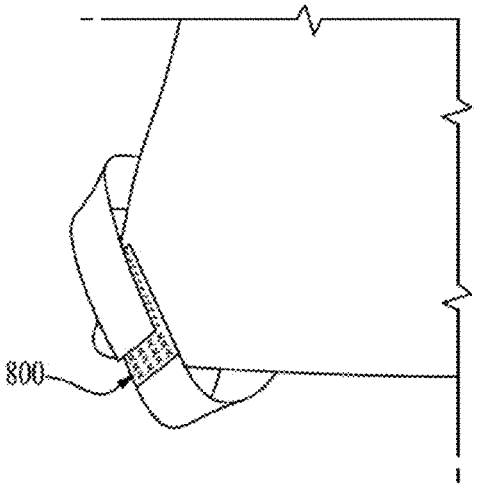
FIG. 8 is a configuration of the attachment straps of another embodiment of the present invention whereby a hook and loop attachment is used (commonly known as "Velcro®") to secure the straps to the body-mounted soft structured baby carrier.

FIG. 8 shows an alternate embodiment of the upper and lower attachment straps (310 and 320) of the baby carrier cover (100) using hook and loop attachment (800) (commonly known as "Velcro®") to secure the straps to the baby carrier, in lieu of a single elastic piece for each the upper attachment strap (310) and lower attachment strap (320).

Figure 9:
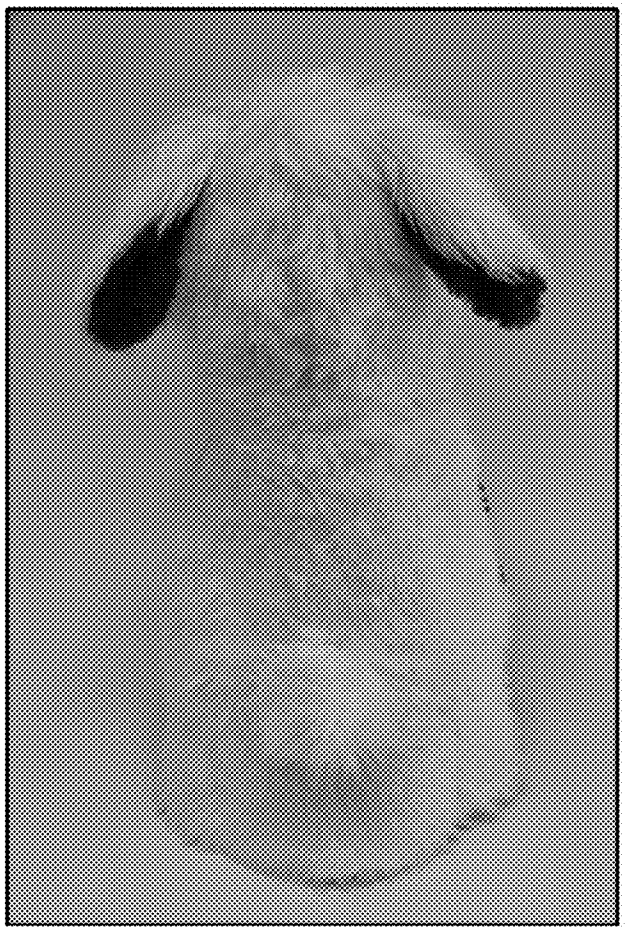
FIG. 9 is a configuration of the outer shell of the baby carrier cover in the general form of a lamb or sheep.

FIG. 9 depicts a configuration of the outer shell (200) of the baby carrier cover (100) in the general form of a lamb or sheep.

Figure 10:
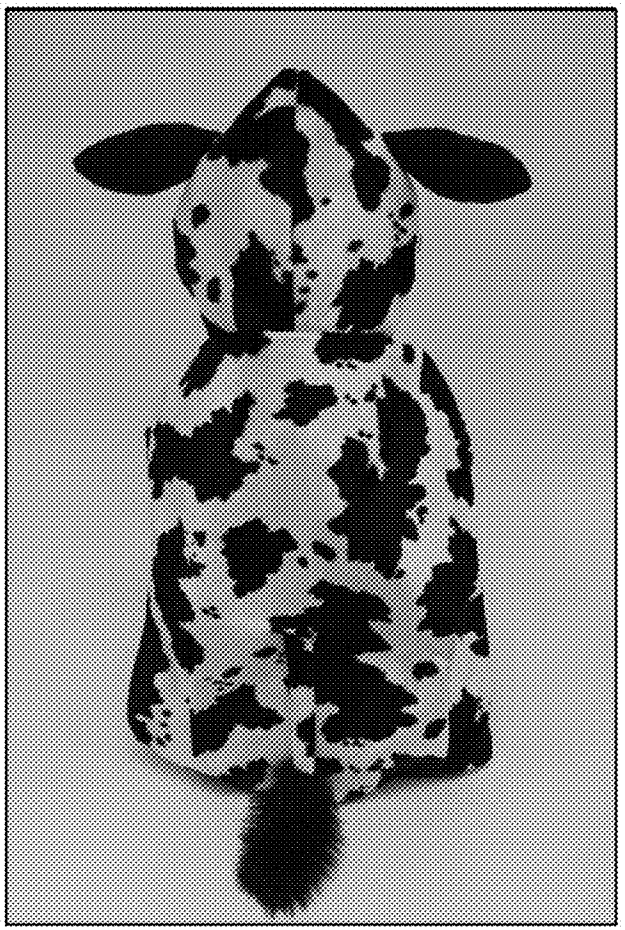
FIG. 10 is a configuration of the outer shell of the of the baby carrier cover in the general form of a cow.

FIG. 10 depicts a configuration of the outer shell (200) of the of the baby earner cover (100) in the general form of a cow.

Figure 11:
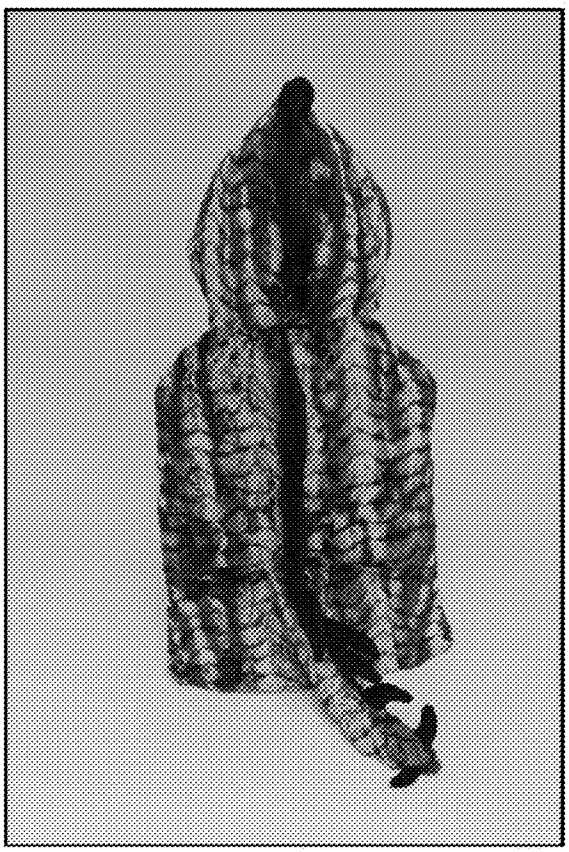
FIG. 11 is a configuration of the outer shell of the of the baby carrier cover in the general form of a dinosaur.

FIG. 11 depicts a configuration of the outer shell (200) of the of the baby carrier cover (100) in the general form of a dinosaur.

Figure 12:
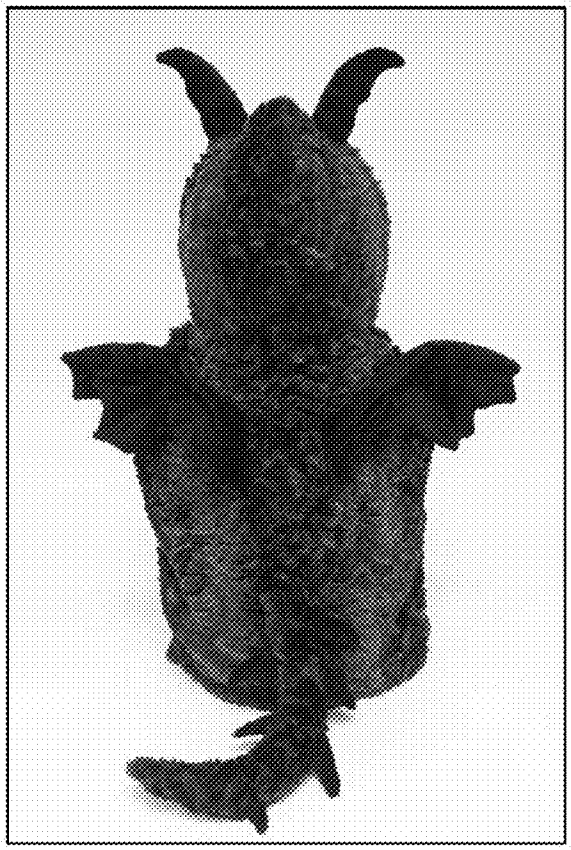
FIG. 12 is a configuration of the outer shell of the of the baby carrier cover in the general form of a dragon.

FIG. 12 depicts a configuration of the outer shell (200) of the of the baby carrier cover (100) in the general form of a dragon.

Figure 13:
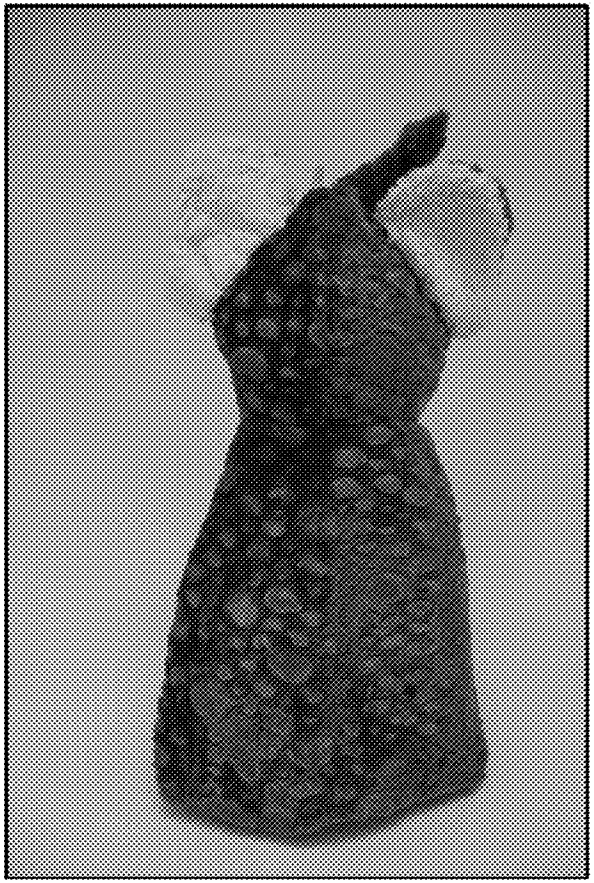
FIG. 13 is a configuration of the outer shell of the of the baby carrier cover in the general form of a elephant.

FIG. 13 depicts a configuration of the outer shell (200) of the of the baby carrier cover (100) in the general form of a elephant.

Figure 14:
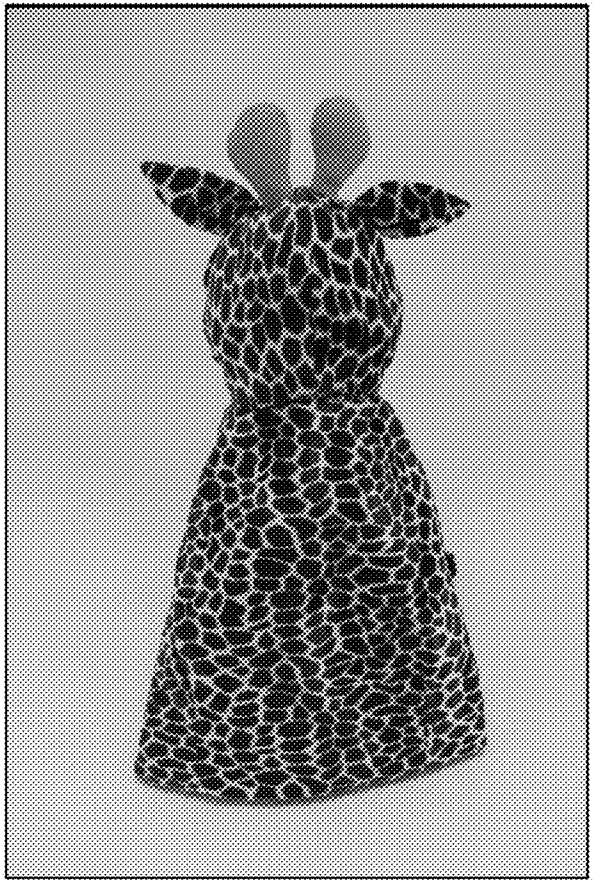
FIG. 14 is a configuration of the outer shell of the of the baby carrier cover in the general form of a giraffe.

FIG. 14 depicts a configuration of the outer shell (200) of the of the baby carrier cover (100) in the general form of a giraffe.

Figure 15:
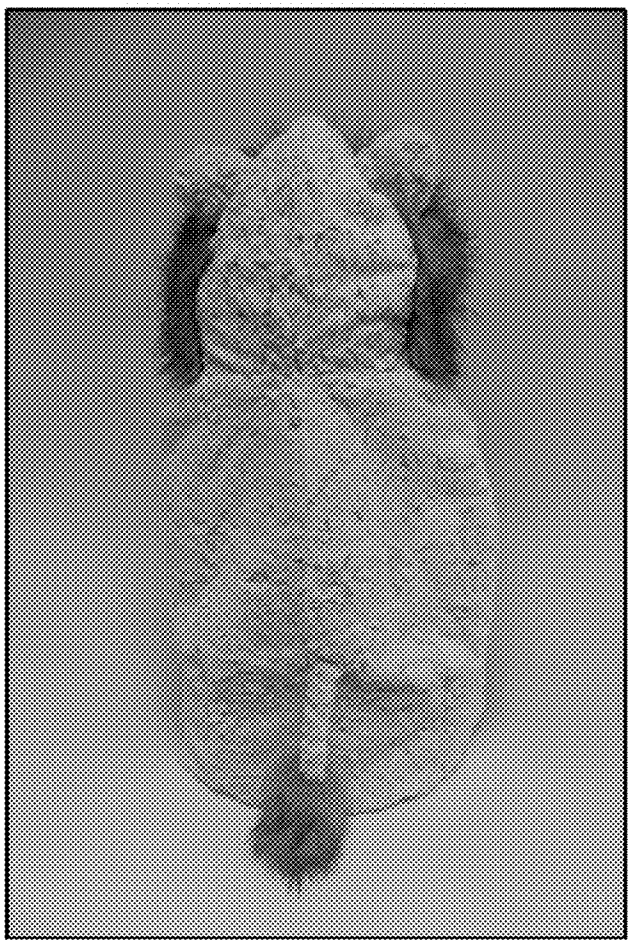
FIG. 15 is a configuration of the outer shell of the of the baby carrier cover in the general form of a lion.

FIG. 15 depicts a configuration of the outer shell (200) of the of the baby carrier cover (100) in the general form of a lion.

Figure 16:
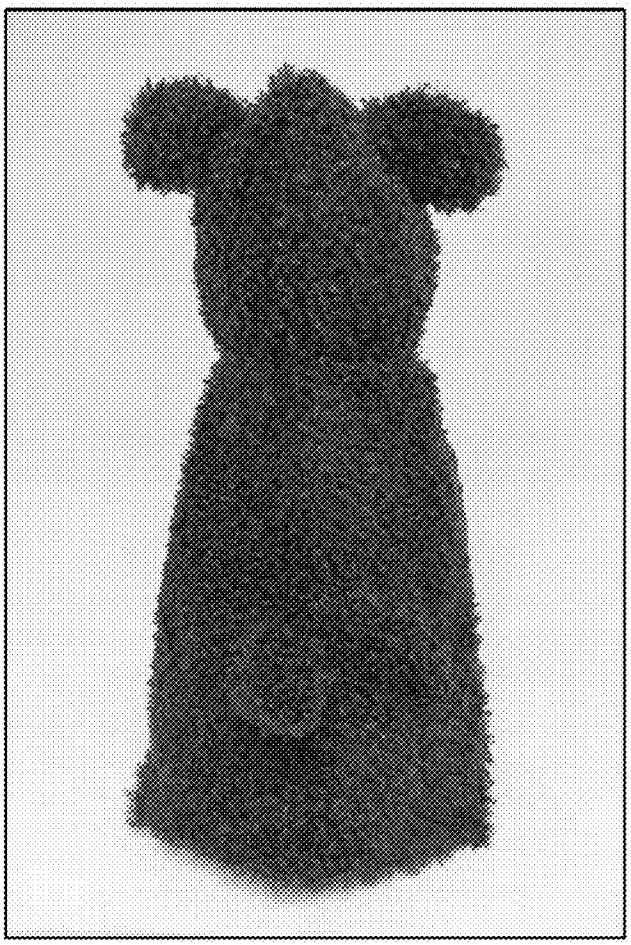
FIG. 16 is a configuration of the outer shell of the of the baby carrier cover in the general form of a bear.

FIG. 16 depicts a configuration of the outer shell (200) of the of the baby carrier cover (100) in the general form of a bear.

Figure 17:
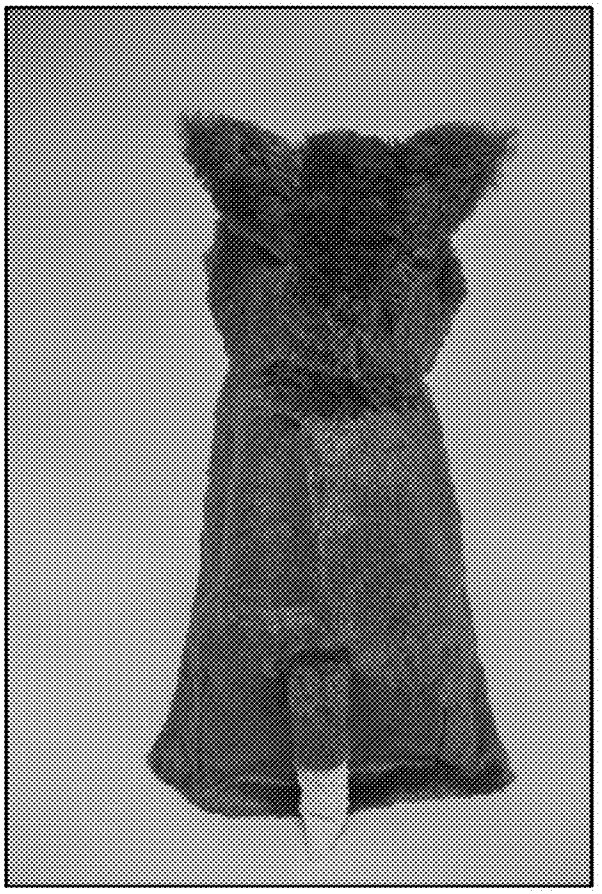
FIG. 17 is a configuration of the outer shell of the of the baby carrier cover in the general form of a fox.

FIG. 17 depicts a configuration of the outer shell (200) of the of the baby carrier cover (100) in the general form of a fox.

Figure 18:
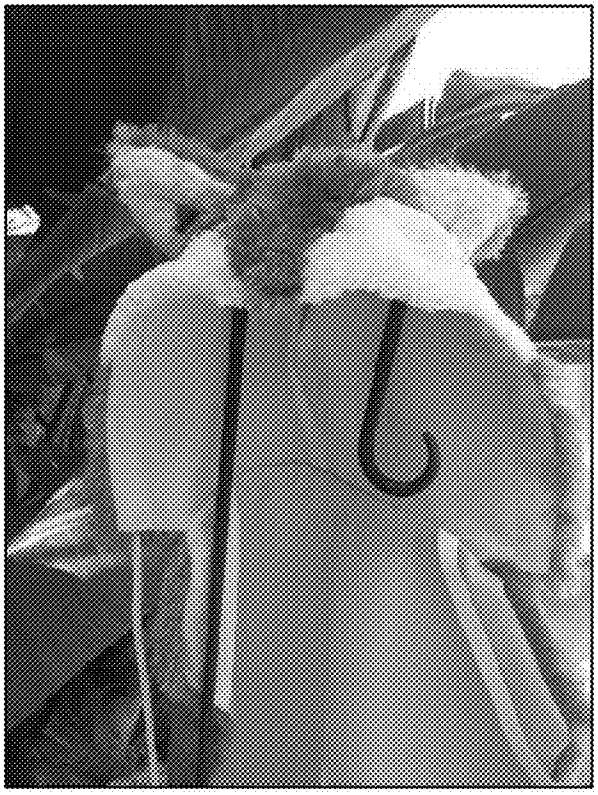
FIG. 18 is a depiction of the inner shell when the configuration of the outer shell of the of the baby carrier cover is in the general form of a dragon.

FIG. 18 depicts the inner shell (300) when the configuration of the outer shell (200) of the of the baby carrier cover is in the general form of a dragon.

Figure 19:
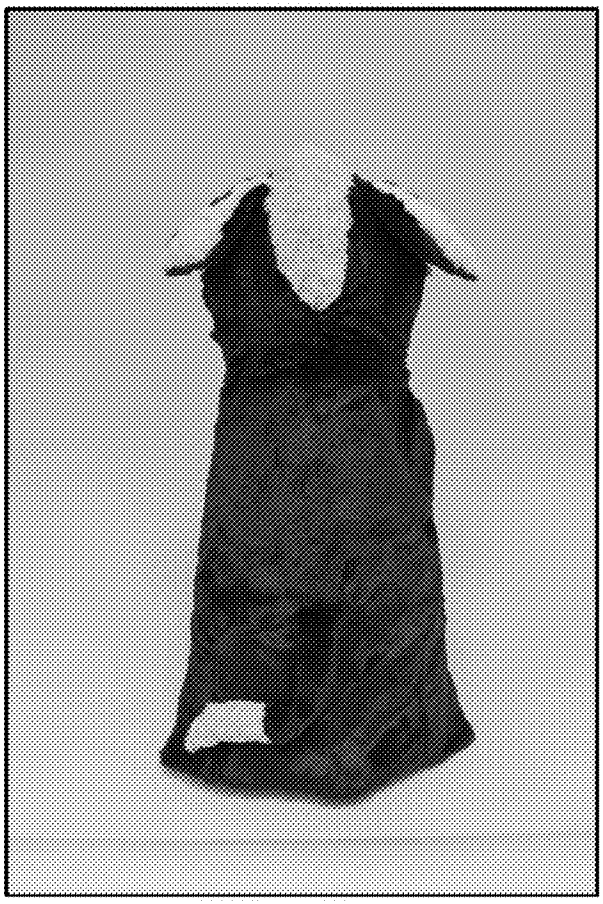
FIG. 19 is a configuration of the outer shell of the of the baby carrier cover in the general form of a horse.

FIG. 19 depicts a configuration of the outer shell (200) of the of the baby carrier cover (100) in the general form of a horse.

Figure 20:
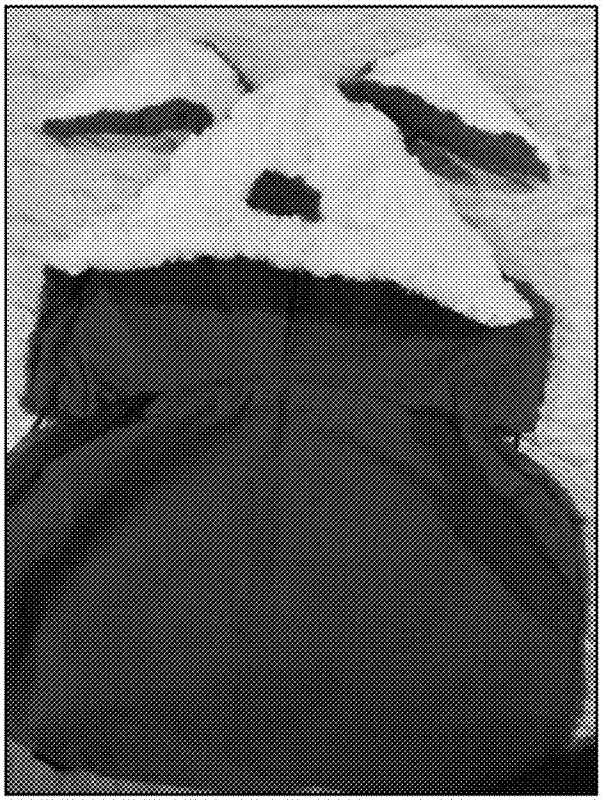
FIG. 20 is a depiction of the inner shell when the configuration of the outer shell of the of the baby carrier cover is in the general form of a horse.

FIG. 20 depicts the inner shell (300) when the configuration of the outer shell (200) of the of the baby carrier cover (100) is in the general form of a horse.

Figure 21:
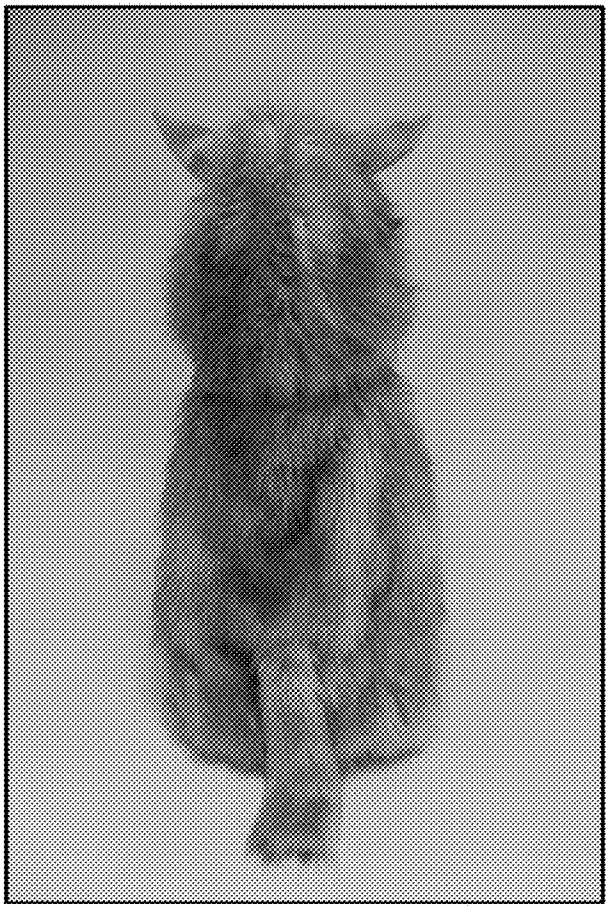
FIG. 21 is a configuration of the outer shell of the of the baby carrier cover in the general form of a fantastical creature.

FIG. 21 depicts a configuration of the outer shell (200) of the of the baby carrier cover (100) in the general form of a fantastical creature.

Although specific embodiments of the baby carrier cover have been described, various modifications, alterations, alternative constructions, and equivalents are also encompassed within the scope of these inventions.

The specification and figures are, accordingly, to be regarded in an illustrative rather than a restrictive sense. It will, however, be evident that additions, subtractions, deletions, and other modifications and changes may be made thereunto without departing from the broader spirit and scope of the inventions as set forth in the claims.

What is claimed is:

1. A cover assembly for a chest-mounted soft structured baby carrier comprising:

an outer shell; wherein the outer shell is configured to have a shape; wherein the outer shell extends above a chest-mounted soft structured baby carrier, further comprising a hood; an inner shell, wherein the inner shell has an upper portion and a lower portion; a pair of upper attachment straps, wherein each upper attachment strap is anchored to the upper portion of the inner shell; and a pair of lower attachment straps, wherein each lower attachment strap is anchored to the lower portion of the inner shell and removably attached to a lower securing strap of the baby carrier.

2. The cover assembly of claim 1 wherein the shape is selected from a group comprising dog, cat, panda, cow, lion, tiger, bear, shark, giraffe, turtle, koala, kangaroo, and dinosaur.

3. The cover assembly of claim 1 wherein the shape is selected from a group comprising dragon, unicorn, and hobbit.

4. The cover assembly of claim 1 wherein the pair of lower attachment straps each comprises a single piece of elastic fabric.

5. The cover assembly of claim 1 wherein the pair of upper attachment straps each comprises a single piece of elastic fabric.

6. The cover assembly of claim 1 wherein the pair of lower attachment straps each use buttons to secure the lower attachment straps to the chest-mounted soft structured baby carrier.

7. The cover assembly of claim 1 wherein the pair of upper attachment straps each use buttons to secure the upper attachment straps to the chest-mounted soft structured baby carrier.

8. The cover assembly of claim 1 wherein the pair of lower attachment straps each use snaps to secure the lower attachment straps to the chest-mounted soft structured baby carrier.

9. The cover assembly of claim 1 wherein the pair of upper attachment straps each use snaps to secure the upper attachment straps to the chest-mounted soft structured baby carrier.

10. The cover assembly of claim 1 wherein the pair of upper attachment straps each use a hook and loop attachment to secure the upper attachment straps to the chest-mounted soft structured baby carrier.

11. The cover assembly of claim 1 wherein the pair of lower attachment straps each use a hook and loop attachment to secure the lower attachment straps to the chest-mounted soft structured baby carrier.

12. The cover assembly of claim 1 wherein the hood further comprises a string which can be used to tighten the hood around the head of a baby being carried in a chest-mounted soft structured baby carrier.

13. The cover assembly of claim 1 wherein the hood is made of fabric with an operative thickness to provide protection from the sun and other elements.

* * * * *